US007675247B2

(12) United States Patent
Okimura

(10) Patent No.: US 7,675,247 B2
(45) Date of Patent: Mar. 9, 2010

(54) REMOTE CONTROL TRANSMITTER WHICH IS CAPABLE OF CONTROLLING A PLURALITY OF LIGHT FITTINGS WITHOUT THE NEED FOR A SLIDABLE SWITCH

(75) Inventor: Katsuyuki Okimura, Tokyo (JP)

(73) Assignee: NEC Lighting, Ltd. (JP)

( * ) Notice: Subject to any disclaimer, the term of this patent is extended or adjusted under 35 U.S.C. 154(b) by 134 days.

(21) Appl. No.: 11/838,842

(22) Filed: Aug. 14, 2007

(65) Prior Publication Data

US 2008/0074241 A1 Mar. 27, 2008

(30) Foreign Application Priority Data

Sep. 26, 2006 (JP) ..... 2006-260327

(51) Int. Cl.
*G05F 1/00* (2006.01)

(52) U.S. Cl. ..... 315/291; 315/294; 340/825.22

(58) Field of Classification Search ..... 315/151–154, 315/209 R, 291, 307, 312, 360–362; 340/309.4, 340/309.5, 309.16, 332, 825.22, 825.37, 340/825.76, 815.6, 825, 825.69, 825.72
See application file for complete search history.

(56) References Cited

U.S. PATENT DOCUMENTS

| | | | | |
|---|---|---|---|---|
| 5,187,472 | A * | 2/1993 | Hart et al. | 340/825.69 |
| 5,578,999 | A * | 11/1996 | Matsuzawa et al. | 340/825.22 |
| 6,300,727 | B1 * | 10/2001 | Bryde et al. | 315/294 |
| 6,624,597 | B2 * | 9/2003 | Dowling et al. | 315/291 |
| 7,355,523 | B2 * | 4/2008 | Sid | 340/825.52 |
| 2006/0017857 | A1 | 1/2006 | Sata et al. | 348/734 |

FOREIGN PATENT DOCUMENTS

| | | |
|---|---|---|
| JP | 60-31396 | 2/1985 |
| JP | 2-162997 | 6/1990 |
| JP | 4-301996 | 10/1992 |
| JP | 6-113365 | 4/1994 |
| JP | 07-122368 | 5/1995 |
| JP | 8-47057 | 2/1996 |
| JP | 10-326680 | 12/1998 |
| JP | 11-285083 | 10/1999 |
| JP | 3164158 | 3/2001 |
| JP | 2001-285970 | 10/2001 |
| JP | 2003-217869 | 7/2003 |
| JP | 2006-33680 | 2/2006 |

* cited by examiner

*Primary Examiner*—Douglas W Owens
*Assistant Examiner*—Jimmy T Vu
(74) *Attorney, Agent, or Firm*—Hayes Soloway P.C.

(57) ABSTRACT

A remote control transmitter is capable of controlling a plurality of light fittings without the need for a slidable switch. The remote control transmitter includes a memory for storing data representing a plurality of control signals for respective channels corresponding respectively to the light fittings, a measurer for calculating a period of time during which the operation button is pressed based on a detected event starting when the operation button is pressed and ending when the operation button is released, and outputting a signal representing the calculated period of time, a transmitter for outputting a control signal based on the data stored in the memory, and a controller for setting one of the channels based on the signal output from the measurer, and controlling the transmitter to output a control signal based on the data stored in the memory in association with the set channel.

4 Claims, 1 Drawing Sheet

REMOTE CONTROL TRANSMITTER WHICH IS CAPABLE OF CONTROLLING A PLURALITY OF LIGHT FITTINGS WITHOUT THE NEED FOR A SLIDABLE SWITCH

This application is based upon and claims the benefit of priority from Japanese Patent Application No. 2006-260327 filed on Sep. 26, 2006, the content of which is incorporated by reference.

BACKGROUND OF THE INVENTION

1. Field of the Invention

The present invention relates to a remote control transmitter for transmitting remote control signals to remotely controlled light fittings.

2. Description of the Related Art

Some remote control transmitters for use with remotely controlled light fittings include a slidable channel selector switch for controlling a plurality of light fittings, as disclosed in Japanese patent No. 3164158, for example.

FIG. 1 of the accompanying drawings is a block diagram showing such a remote control transmitter of the related art for use with remotely controlled light fittings.

As shown in FIG. 1, the remote control transmitter of the related art comprises channel selector switch 1 for selecting a light fitting 22 *a, b* to be controlled, operation button 2 for starting to operate the selected light fitting 22 *a, b*, controller 3 for outputting a control signal corresponding to a channel set by channel selector switch 1, transmitter 4 for transmitting the control signal output from controller 3 to the light fitting 22 *a, b*, and memory 5 for storing data including control signals for respective channels corresponding to the light fittings 22 *a, b*. The remote control transmitter also includes a cell (not shown) for supplying electric power to controller 3.

It is assumed that the remote control transmitter of the related art has two channels, one referred to as channel 1 and the other as channel 2.

When operation button 2 is pressed, each of the light fittings 22 a, b is operable selectively in different modes, e.g., a turn-on mode, a turn-off mode, and a dimmer control mode.

When operation button 2 is pressed, while either channel 1 or channel 2 is being set by channel selector switch 1, controller 3 outputs a control signal representing operation details of the light fitting 22 *a, b* stored in association with the set channel. The control signal output from controller 3 is transmitted from transmitter 4.

When the light fitting 22 *a, b* corresponding to the channel set by channel selector switch 1 receives the control signal, the light fitting 22 *a, b* starts to operate.

If a slidable switch is used as channel selector switch 1 for controlling the light fittings 22 *a, b*, then channel selector switch 1 may possibly suffer the following problems:

The slidable switch includes parts that are usually joined by soldering. If stress greater than an allowable level is applied to the soldered parts when the slidable switch is operated to change the channels, or if the slidable switch is used beyond an allowed period of time, then solder cracks tend to develop to an extent that the slidable switch is no longer operable to change the channels, In addition, it is necessary that the slidable switch be disposed in a highly accurate position. If the slidable switch is not installed in a position in accordance with the design specifications, then the switch may come into contact with the casing of the remote control transmitter which will prevent it from performing a sliding action.

SUMMARY OF THE INVENTION

It is an exemplary object of the present invention to provide a remote control transmitter which is capable of controlling a plurality of light fittings without the need for a slidable switch.

To achieve the above object, there is provided in accordance with the present invention a remote control transmitter including an operation button for starting to operate a plurality of light fittings, comprising a memory for storing data representing a plurality of control signals for respective channels corresponding respectively to the light fittings, a measurer for calculating a period of time during which the operation button is pressed based on a detected event starting when the operation button is pressed and ending when the operation button is released, and outputting a signal representing the calculated period of time as a measured period of time, a transmitter for outputting a control signal based on the data stored in the memory, and a controller for setting one of the channels based on the signal output from the measurer, and controlling the transmitter to output a control signal based on the data stored in the memory in association with the set channel.

The above and other objects, features, and advantages of the present invention will become apparent from the following description with reference to the accompanying drawings which illustrate examples of the present invention.

DETAILED DESCRIPTION OF THE PREFERRED EMBODIMENT

Figure 1:
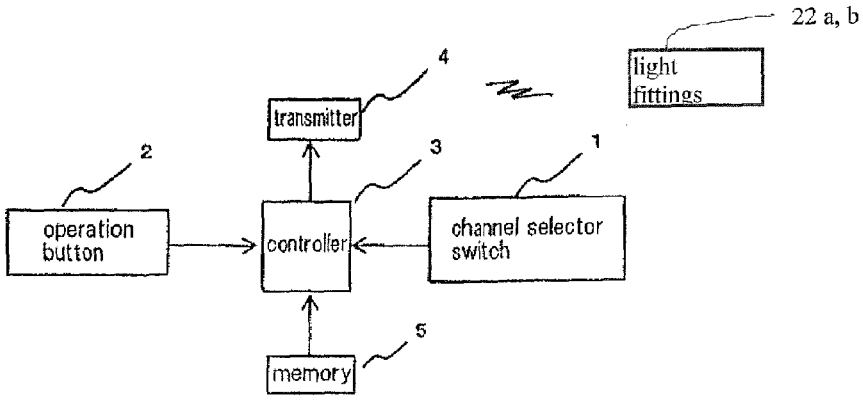
Fig. 1 PRIOR ART
FIG. 1 is a block diagram of a remote control transmitter according to the related art.
Figure 2:
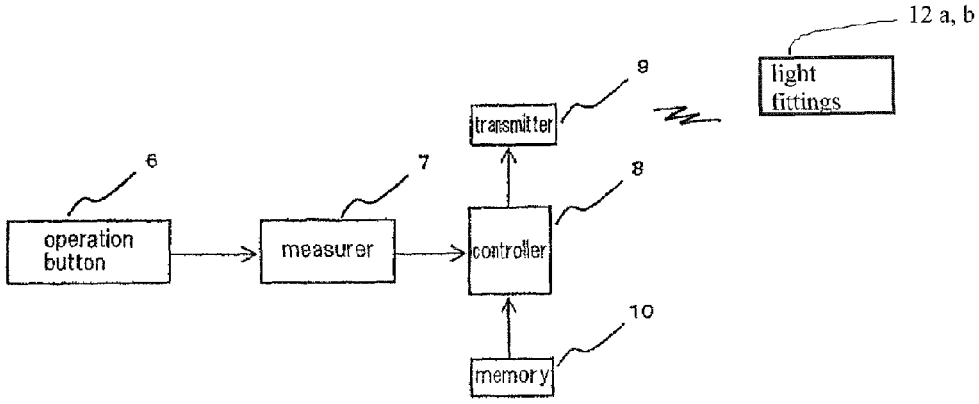
FIG. 2 is a block diagram of a remote control transmitter according to an exemplary embodiment of the present invention.

FIG. 2 shows in block form a remote control transmitter according to exemplary embodiment of the present invention.

The remote control transmitter shown in FIG. 2 comprises operation button 6 for starting to operate light fittings 12 *a, b*, measurer 7 for starting to measure a period of time during which operation button 6 is pressed, controller 8 for setting a channel based on the period of time measured by measurer 7 and outputting a control signal representing the channel and an operation mode of the light fitting 12 *a, b*, transmitter 9 for transmitting the control signal output from controller 8 to the light fitting 12 *a, b*, and memory 10 for storing data indicative of control signals for respective channels corresponding to the light fittings 12 *a, b*. The remote control transmitter also includes a cell (not shown) for supplying electric power to controller 8.

It is assumed that the remote control transmitter has two channels, one referred to as channel 1 and the other as channel 2.

Operation button 6 is mounted on a surface of the casing of the remote control transmitter. Structural details of operation button 6 are identical to those of the operation button of the remote control transmitter of the related art, and will not be described in detail below.

Measurer 7 measures a period of time during which operation button 6 is pressed. Measurer 7 outputs a signal representing the measured period of time to controller 8. When the output of the signal to controller 8 is finished, measurer 7 resets the measured period of time to 0 (second).

In order for measurer 7 to measure a period of time during which operation button 6 is pressed, measurer 7 may detect positive and negative going edges of a signal that is output while operation button 6 is being pressed, and calculate the period of time during which the signal is output.

If the measured period of time represented by the signal input from measurer 7 is shorter than a predetermined period of time, then controller 8 reads data that corresponds to channel 1 stored in memory 10. If the measured period of time represented by the signal input from measurer 7 is longer than the predetermined period of time, then controller 8 reads data that is correspond to channel 2 stored in memory 10. In this manner, controller 8 sets a channel.

Controller 8 reads a control signal representing the set channel and the operation mode of the light fitting 12 *a, b* from the data stored in memory 10, and controls transmitter 9 to output the control signal.

Operation of the remote control transmitter according to the embodiment will be described below.

When the user presses and then releases operation button 6, if the period of time measured by measurer 7 is shorter than the predetermined period of time, then controller 8 sets the channel to channel 1. Conversely, if the period of time measured by measurer 7 is longer than the predetermined period of time, then controller 8 sets the channel to channel 2. It is assumed that the maximum period of time which can be measured by measurer 7 is sufficiently longer than the predetermined period of time. Then, controller 8 reads a control signal representing the set channel and the operation mode of the light fitting 12 *a, b* from the data stored in memory 10, and controls transmitter 9 to output the control signal.

The predetermined period of time referred to above may be the maximum period of time which can be measured by measurer 7. In such a case, when a signal indicating that the measured period of time reaches the predetermined period of time is input from measurer 7, controller 8 sets the channel to channel 2, and controls transmitter 9 to output a control signal that corresponds to channel 2. At this time, transmitter 9 keeps outputting the control signal that corresponds to channel 2 even if the user continuously presses operation button 6 beyond the predetermined period of time.

Therefore, when the user wants to operate the light fitting 12 *b*, e.g., that corresponds to channel 2, the user does not need to adjust time.

As described above, the remote control transmitter according to the embodiment stores data representing the two channels, i.e., channel 1 and channel 2, and the operation modes of the light fittings 12 *a, b*. The remote control transmitter sets a channel based on the period of time during which the operation button is pressed for starting to operate a light fitting 12 *a, b*. The remote control transmitter reads a control signal representing the set channel and the operation mode of the light fitting 12 *a, b* from the data, and transmits the control signal. When the channel is set, the remote control transmitter resets the measured period of time.

Since the channel is set based on the period of time during which the operation button is pressed, the remote control transmitter can change the channels without the need for a switch that requiring a slidable operation. The user can adjust the period of time during which the operation button is pressed to thereby independently control the light fittings 12 *a, b* assigned respectively to the different two channels.

The channel setting may be performed independently from the control of operation of the light fittings 12 *a, b*.

Figure 3:
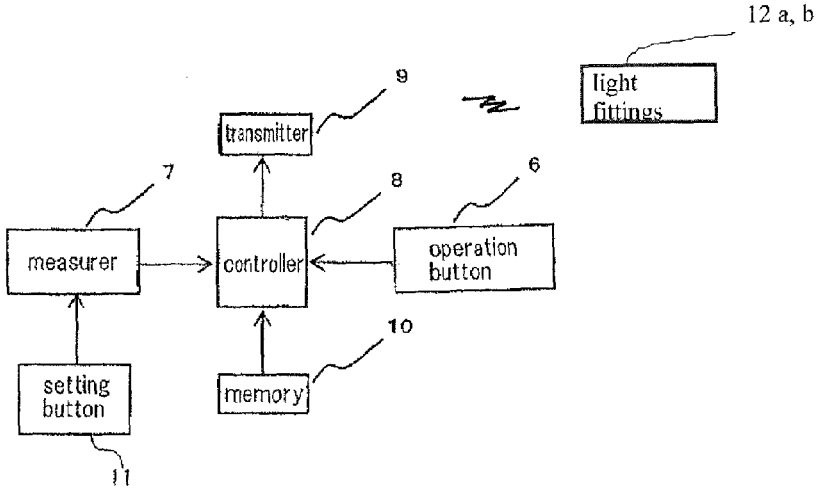
FIG. 3 is a block diagram of a remote control transmitter according to an exemplary embodiment of the present invention.

FIG. 3 shows in block form a remote control transmitter according to an exemplary embodiment of the present invention.

The remote control transmitter shown in FIG. 3 adds setting button 11 in order to set channels.

The remote control transmitter shown in FIG. 3 sets a channel based on the period of time during which setting button 11 is pressed. In this case, the remote control transmitter is not limited to controlling light fittings 12 *a, b*, but may be used to operate AV (Audio Visual) devices including television sets and video decks which need complex control.

The channels that can be set by the remote control transmitter are not limited to two channels, but may be three or more channels.

For example, channels may be set based on the number of signals that are each output when setting button 11 is pressed. Alternatively, a given period of time may be divided into three or more time intervals which are assigned to respective different channels, and one of the channels may be set based on the measured period of time during which setting button 11 is pressed.

If the channels that are set are indicated by respective different colors, then the user finds it easy to visually recognize the channels on the remote control transmitter. To indicate the channels with respective different colors, the remote control transmitter may employ an LED (Light-Emitting Diode) capable of emitting light in a plurality of colors.

According to the present invention, since a channel is set based on the period of time during which the operation button or the setting button is pressed, it is possible to change channels without the need for a switch that requiring a slidable operation. The user can control a plurality of light fittings 12 *a, b* by adjusting the period of time during which the operation button or the setting button is pressed.

While preferred embodiments of the present invention have been described using specific terms, such description is for illustrative purposes only, and it is to be understood that changes and variations may be made without departing from the spirit or scope of the following claims.

What is claimed is:

1. A remote control transmitter including an operation button for starting to operate a plurality of light fittings, comprising:

a memory for storing data representing a plurality of control signals for respective channels corresponding respectively to the light fittings;

a measurer for calculating a period of time during which said operation button is pressed based on a detected event starting when said operation button is pressed and ending when said operation button is released, and outputting a signal representing the calculated period of time as a measured period of time;

a transmitter for outputting a control signal based on the data stored in said memory; and a controller for setting one of the channels based on said signal output from said measurer, and controlling said transmitter to output a control signal based on the data stored in said memory in association with the set channel, wherein said controller sets said first channel if said measured period of time represented by said signal output from said measurer is shorter than a predetermined period of time, and sets said second channel if said measured period of time represented by said signal output from said measurer is longer than said predetermined period of time.

2. The remote control transmitter according to claim 1, wherein said measurer sets a maximum period of time which can thereby be measured as said predetermined period of time; and said controller sets said second channel if a signal indicating that said measured period of time reaches said maximum period of time is supplied from said measurer to said controller.

3. A remote control transmitter including an operation button for starting to operate a plurality of light fittings, comprising:

a memory for storing data representing a plurality of control signals for respective channels corresponding respectively to the light fittings;

a setting button for setting said channels;

a measurer for calculating a period of time during which said setting button is pressed based on a detected event starting when said setting button is pressed and ending when said setting button is released, and outputting a signal representing the calculated period of time as a measured period of time;

a transmitter for outputting a control signal based on the data stored in said memory; and a controller for setting one of the channels based on said signal output from said measurer, and controlling said transmitter to output a control signal based on the data stored in said memory in association with the set channel, wherein said controller sets said first channel if said measured period of time represented by said signal output from said measurer is shorter than a predetermined period of time, and sets said second channel if said measured period of time represented by said signal output from said measurer is longer than said predetermined period of time.

4. The remote control transmitter according to claim 3, wherein said measurer sets a maximum period of time which can thereby be measured as said predetermined period of time; and said controller sets said second channel if a signal indicating that said measured period of time reaches said maximum period of time is supplied from said measurer to said controller.

* * * * *